US008652301B2

(12) United States Patent
Bryant et al.

(10) Patent No.: US 8,652,301 B2
(45) Date of Patent: Feb. 18, 2014

(54) METHOD AND COMPOSITION FOR ENZYMATIC TREATMENT OF FIBER FOR PAPERMAKING, AND PAPER PRODUCTS MADE THEREWITH

(71) Applicant: Buckman Laboratories International, Inc., Memphis, TN (US)

(72) Inventors: Stephen D. Bryant, Memphis, TN (US); Kevin J. MacDonald, Memphis, TN (US); Bernard Janse, Memphis, TN (US); Xiangdong Zhou, Memphis, TN (US); Philip Hoekstra, Memphis, TN (US); Daniel E. Glover, Memphis, TN (US)

(73) Assignee: Buckman Laboratories International, Inc., Memphis, TN (US)

( * ) Notice: Subject to any disclaimer, the term of this patent is extended or adjusted under 35 U.S.C. 154(b) by 0 days.

(21) Appl. No.: 13/661,334

(22) Filed: Oct. 26, 2012

(65) Prior Publication Data

US 2013/0105100 A1 May 2, 2013

Related U.S. Application Data

(60) Provisional application No. 61/552,007, filed on Oct. 27, 2011.

(51) Int. Cl.
*D21H 11/00* (2006.01)

(52) U.S. Cl.
USPC ..... 162/181.1; 162/181.2; 435/188

(58) Field of Classification Search
USPC ..... 162/181.2, 199; 435/188, 262, 265, 101
See application file for complete search history.

(56) References Cited

U.S. PATENT DOCUMENTS

| | | | | |
|---|---|---|---|---|
| 5,256,252 | A | 10/1993 | Sarkar et al. | |
| 5,582,681 | A * | 12/1996 | Back et al. | 162/5 |
| 6,027,610 | A * | 2/2000 | Back et al. | 162/111 |
| 7,862,688 | B2 * | 1/2011 | Thomas | 162/177 |
| 2005/0000666 | A1 * | 1/2005 | Taylor et al. | 162/24 |
| 2007/0169903 | A1 * | 7/2007 | Covarrubias et al. | 162/158 |
| 2008/0248160 | A1 * | 10/2008 | Steer et al. | 426/20 |
| 2008/0283207 | A1 * | 11/2008 | Thomas | 162/177 |
| 2009/0107643 | A1 * | 4/2009 | Petit-Conil et al. | 162/68 |
| 2009/0221051 | A1 * | 9/2009 | Steer et al. | 435/165 |
| 2010/0269989 | A1 | 10/2010 | Wang et al. | |
| 2010/0291650 | A1 * | 11/2010 | Larsen et al. | 435/165 |
| 2011/0300587 | A1 | 12/2011 | Zhou | |

FOREIGN PATENT DOCUMENTS

| | | | |
|---|---|---|---|
| DE | 10126988 | A1 | 12/2002 |
| WO | 96-00811 | A1 | 1/1996 |
| WO | 96-11262 | A1 | 4/1996 |
| WO | 98-08940 | A1 | 3/1998 |
| WO | 03-035972 | A1 | 5/2003 |
| WO | 03-106654 | A2 | 12/2003 |
| WO | 2004-101889 | A2 | 11/2004 |
| WO | 2005-106110 | A1 | 11/2005 |
| WO | 2009-095781 | A1 | 8/2009 |

OTHER PUBLICATIONS

Pastor, F.I.J. et al., "Xylanases: Molecular Properties and Applications," Industrial Enzymes, 2007, pp. 65-67, 74-79.

Smook, G.A., "Bleaching," Handbook for Pulp and Paper Technologists, Second Ed., 1992, Angus Wilde Publ., pp. 163-164.

International Search Report and Written Opinion issued in corresponding International Patent Application No. PCT/US2012/062058 dated May 28, 2013 (12 pages).

* cited by examiner

*Primary Examiner* — Mark Halpern
(74) *Attorney, Agent, or Firm* — Kilyk & Bowersox, P.L.L.C.

(57) ABSTRACT

A method is provided for controlling organic contaminants, such as xylans, pitch or both, that interfere with bleaching of fibers and/or cause other interference(s) in papermaking systems. The method includes contacting fibers before any bleaching thereof with a composition which contains a hemicellulolytic enzyme and an organic contaminant removal adjuvant to liberate the organic contaminants from the fibers. The treated fibers can then be bleached and further used, for example, in making paper. The present invention also relates to the treatment compositions and to paper products made with fiber materials treated with these compositions. A method of enhancing enzymatic degradation of a substrate as well as formulations and systems for achieving the same are also provided. Various substrates can be degraded or otherwise processed, including biomass, paper mill sludge, and animal hides. Enzymatic degradation can be enhanced by including one or more polymeric surfactants.

16 Claims, 4 Drawing Sheets

Table I

Ep Stage Summary

| Sample ID | Xylanase, g/mT | Surfactant, g/mT | Brightness, % ISO (Avg) | Brightness Increase | L* (Avg) | a* (Avg) | b* (Avg) | Yield, % |
|---|---|---|---|---|---|---|---|---|
| Control | 0 | 0 | 77.81 | n/a | 95.08 | -0.69 | 8.84 | 97.1 |
| XylA | 500 | 0 | 77.60 | -0.21 | 95.10 | -0.65 | 8.96 | 97.5 |
| XylA+Surf | 500 | 500 | 78.54 | 0.74 | 95.27 | -0.73 | 8.58 | 97.3 |
| XylB | 500 | 0 | 78.01 | 0.20 | 95.20 | -0.77 | 8.82 | 95.8 |
| XylB+Surf | 500 | 500 | 78.75 | 0.94 | 95.34 | -0.81 | 8.46 | 93.3 |
| LBL CONC | 250 | 0 | 78.30 | 0.50 | 95.21 | -0.75 | 8.58 | 96.2 |

METHOD AND COMPOSITION FOR ENZYMATIC TREATMENT OF FIBER FOR PAPERMAKING, AND PAPER PRODUCTS MADE THEREWITH

This application claims the benefit under 35 U.S.C. §119 (e) of prior U.S. Provisional Patent Application No. 61/552,007, filed Oct. 27, 2011, which is incorporated in its entirety by reference herein.

FIELD OF THE INVENTION

The present invention relates to a method and a composition for controlling organic contaminants that interfere with bleaching of fibers in papermaking systems. More particularly, the present invention relates to a method and a composition useful therein for controlling such organic contaminants comprising contacting fibers before any bleaching thereof with a composition including at least one hemicellulolytic enzyme and at least one organic contaminant removal adjuvant to liberate the bleach-interfering organic contaminants from the fibers. The present invention also relates to paper products made with fiber materials treated with these compositions. The present invention further relates to methods of enhancing enzymatic activity of enzymes in various contexts.

BACKGROUND OF THE INVENTION

Lignocellulosic material in fiber form is in wide commercial use as a raw material used for the manufacture of paper and other paper products. In papermaking, wood fibers usually are treated by combining them with other additives, and the fibers are then processed into a network of wood fibers, which can constitute a paper or other thin sheet of fibrous material. A variety of paper and paper products are decolored, namely, whitened or brightened, before they are marketed. The manufacture of decolored paper products usually includes process phases of pulping, bleaching, and papermaking. In order to produce strong and bleachable papermaking fibers, the wood or pulp fibers usually are treated to remove lignin, and commonly, the initial part of this treatment takes place in a digester in the presence of chemicals such as sodium hydroxide and sodium sulphide (to produce a kraft pulp) or sulphites, usually sodium or magnesium, (to produce a sulphite pulp), thus producing chemical pulps. The removal of lignin is referred to as delignification. The lignin content of wood pulps usually can be measured by a permanganate oxidation test according to a Standard Method of the Technical Association Of The Pulp And Paper Industry (TAPPI), and can be reported as a Kappa Number. The chemical pulp from the digester still contains an appreciable amount of residual lignin at this stage, and in some cases is suitable for making construction or packaging paper without further purification. For most applications, such as the manufacture of printing, writing, and sanitary papers, for example, the pulp usually is too dark in color and must be brightened by bleaching before papermaking. The paper product brightness is mainly dictated by pulp brightness provided before papermaking. There are some modifications in stock preparation which can alter paper brightness to some extent, such as filler, sizing, whitening agent, dying, and so forth. However, pulp brightness often is a primary factor or limitation on the paper brightness which can be ultimately obtained in paper products derived from the pulp.

Unbleached pulps can exhibit a wide range of brightness values. It is generally understood that chromophoric groups on the lignin are primarily responsible for pulp color. See, e.g., G. A. Smook, *Handbook For Pulp And Paper Technologists*, Chapter 11: Bleaching, 163-164, Tappi Pr. (1992), which is incorporated by reference in its entirety herein. Heavy metal ions (e.g., iron, copper) are also known to form colored complexes with phenolic groups of lignin. Extractive materials also can contribute to the color of mechanical pulps made from resinous woods. To produce high-quality stable paper pulps having a more permanent whitened effect, bleaching methods that decolor pulp have been used. However, use of large quantities of bleaching agents to obtain a specified level of decoloring is often undesirable.

Conventional methods for bleaching pulp have used a variety of multi-stage bleaching sequences, including multiple stages, or steps, with or without washing between the stages. Traditionally, the bleaching sequences have been based on the use of chlorine and chlorine-containing compounds, in one form or another. Some of the chlorine-containing compounds that have been used are chlorine, denoted "C" as a shorthand designation used in the industry, chlorine dioxide, denoted "D", and hypochlorites, denoted "H", usually sodium hypochlorite. Chlorine, with or without admixture of chlorine dioxide, has been commonly employed for the bleaching of chemical pulp, followed by alkaline (caustic) extraction, denoted "E," of the chlorine-treated pulp in an aqueous alkaline medium, which together are denoted C-E. Oxygen, hypochlorite, or oxygen generators such as peroxide, also have been used as a bleaching agent in the bleaching stage, in combination with the alkaline extraction stage, or both. Washing units have been used after bleaching stages and between the oxidation and extraction stages. Additional information on conventional bleaching systems and process designs thereof is shown, for example, in the cited section of the above-referenced *Handbook For Pulp And Paper Technologists*.

Enzymes also have been studied for their use in the treatment of wood fibers to degrade lignocellulosic material. The wood fibers used to make paper products usually include cellulose, hemicellulose, and lignin. The amounts of these three constituents present in the wood fiber can depend on the fiber source and their amounts in paper products made with the fiber can further depend on the manufacturing process used. The cohesion of the plant cell wall is primarily due to the presence of its principal components; the crystalline polymer, cellulose, and the three-dimensional macromolecule, lignin, comprising a lignocellulosic material. These components are embedded in a matrix of pectic and hemicellulotic polysaccharides of various nature. It is generally accepted that the relations that exist between these different polymers are established through linkages of different chemical nature. For instance, blocks of lignin are associated through hemicellulose chains. The hemicellulose, another major component of lignocellulosic material, consists largely of 4-O-methylglucuronoxylan, which includes the β-1,4-linked polymer of D-xylose, and herein referred to as xylan. Generally, hardwood pulps contain larger amounts of xylan than do softwood pulps. Such xylan can be enzymatically hydrolyzed to xylose by an endo-xylanase, β-1,4-D-xylan xylanohydrolase, denoted EC 3.2.1.8, and a xylosidase, β-1,4-D-xylohydrolase. Xylanases per se have been mentioned for xylan degradation in the pulp and paper industry in the pretreatment of pulps before chemical bleaching. See, e.g., F. I. J. Pastor et al., "*Xylanases: Molecular Properties And Applications*," Industrial Enzymes, 65-67, 74-79, 2007. Further, untreated wood also generally contains some amount of pitch, which is typically located in parenchyma cells and on the surfaces of the fiber. Based on solubility in ethyl ether values, pitch may comprise, for example, from about 0.7 to about 2.4 weight percent of hardwoods, such as beech and white birch, and from about 0.7 to about 4.3 weight percent of softwoods such as eastern hemlock and jack pine, based on the total weight of unextracted (oven-dry) wood. The addition of lipase and a cationic polymer to a cellulosic slurry for pitch deposit control has been mentioned. See, e.g., U.S. Pat. No. 5,256,252, which is incorporated by reference in its entirety herein.

The present inventors have recognized a need to control bleach-interfering constituents of wood fiber by a pretreatment of the fibers before bleaching with a combination of agents that can increase pulp brightness obtained from bleaching in a way not predicted from the effects of the individual components of the pretreatment composition.

Enzymes are a significant element of many industrial processes such as paper production, leather preparation, waste treatment, and processing of biomass into fuel. While enzymes can appreciably increase the rate of chemical reactions, finding the right conditions to realize enzyme optimization has proved to be difficult. As a consequence, when enzymes are used they are used in a manner that yields suboptimal enzymatic activity. That inefficiency causes the need to use additional, often costly, enzymes, as well as longer production times and additional energy inputs. Accordingly, there exists a need for enhancing the activity of enzymes to provide more efficient and cost-effective processes.

SUMMARY OF THE PRESENT INVENTION

A feature of the present invention is to provide a method for controlling organic contaminants that comprise xylans, pitch, and/or other fiber components which can interfere with bleaching of the fibers and/or cause other interference(s) in papermaking systems.

An additional feature of the present invention is to provide a method for controlling such bleach-interfering organic contaminants that comprises contacting fibers before any bleaching thereof with a composition that comprises a hemicellulolytic enzyme and an organic contaminant removal adjuvant to liberate the organic contaminants from the fibers.

Another feature of the present invention is to provide a composition comprising a hemicellulolytic enzyme and an organic contaminant removal adjuvant that is useful for pretreating fibers before fiber bleaching in papermaking systems.

A further feature of the present invention is to provide paper products which are produced using the indicated compositions in the indicated methods.

Yet another feature of the present invention is to provide a method for enhancing enzymatic activity of one or more enzymes by using a polymeric surfactant that boosts enzyme activity and allows realization of cost reduction by using less enzyme.

A feature of the present invention is also to provide a formulation containing an enzyme and a polymeric surfactant, for example, which together can be applied to a substrate composition for degradation of the same, wherein the polymeric surfactant significantly increases the activity of the enzyme.

An additional feature of the present invention is to provide better systems for degrading substrate compositions in the presence of an enzyme and a polymeric surfactant, wherein the system enables the enzyme to better penetrate into substrates.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention relates, in part, to a method for controlling organic contaminants that interfere with bleaching of fibers and/or cause other interference(s) in papermaking systems. The method includes contacting, prior to any bleaching step, the fibers with a composition comprising at least one hemicellulolytic enzyme and at least one organic contaminant removal adjuvant to provide treated fibers from which organic contaminants liberate from the fibers in greater amount than wherein the fibers are contacted with the composition without the organic contaminant removal adjuvant, and then bleaching the treated fibers. The interfering organic contaminants that are liberated by treatment of the fibers with the composition can comprise one or more xylans, one or more pitch components, or both. As an option, the contacting step of the method removes at least 50% by weight of total xylans and pitch components present in the fibers prior to the contacting. As an option, the organic contaminant removal adjuvant can be an nonionic surfactant. As another option, the nonionic surfactant can be a poloxamer, such as, for example, a poloxamer having an HLB value of 16 or more. The hemicellulolytic enzyme can be xylanase, mannanase, or both. The composition can further comprise a lipolytic enzyme. The composition can be introduced in an amount providing from about 100 to about 1,000 grams of said hemicellulolytic enzyme per ton of the fibers on a dry fiber basis, and from about 2 to about 100 grams of said organic contaminant removal adjuvant per ton of the fibers on dry fiber basis. For purposes of the present invention throughout, unless otherwise indicated, references to "ton" are to metric tons (1,000 kg). As an option, the bleached fibers can be formed into a paper product, and the paper product can have an ISO Brightness that is from about 0.5 to about 1.0 units higher than a paper product produced with the same method without the organic contaminant removal adjuvant included in the pretreatment composition.

The present invention also relates to a composition comprising at least one hemicellulolytic enzyme and at least one organic contaminant removal adjuvant capable of removing organic contaminants comprising one or more xylans, one or more pitch components, or both, from fibers in a greater amount than wherein the fibers are contacted with the same composition without the organic contaminant removal adjuvant included in the composition. The organic contaminant removal adjuvant can comprise the indicated materials. The composition can comprise from about 10% to about 90% by weight of the hemicellulolytic enzyme, and from about 1% to about 10% by weight of the organic contaminant removal adjuvant, based on total solids weight of the composition.

The present invention further relates to a paper product formed from the paper forming method of the present invention.

The present invention also relates to a method of enhancing enzymatic degradation of a substrate. The method can include adding at least one polymeric surfactant and at least one enzyme to a composition for the degradation of a substrate. The composition, for example, can contain paper pulp, paper mill sludge, an animal hide, other materials, and the like. A nonionic polymeric surfactant, for example, can be used. The polymeric surfactant can include at least one nonionic block copolymer of the type PEO-PPO-PEO that terminates in primary hydroxyl groups. The nonionic polymeric surfactant can have a hydrophilic-lipophilic balance (HLB) value of at least 17. The nonionic polymeric surfactant can include a propoxylated block copolymer having an HLB value of at least 20. The enzyme, for example, can include a cellulase, a xylanase, a laccase, an amylase, a lipase, a protease, a peroxidase, or any combinations thereof. The substrate composition can be degraded in the presence of the polymeric surfactant and enzyme to form a degradation product and the degradation product can optionally be dewatered.

The present invention further relates to systems for carrying out the described methods and formulations containing an enzyme and a polymeric surfactant for use in the methods. The present invention can be practiced in accordance with or using components, compositions, methods, steps, and/or systems as described, for example, in U.S. Patent Application Publication No. 2011/0300587, incorporated herein in its entirety by reference.

As used herein, a "contaminant" refers to a component with the fiber and/or on the fiber, and/or of the fiber that can cause interference, in a negative or detrimental way, with the processing and/or result in a papermaking system.

As used herein, a "hemicellulolytic enzyme" refers to an enzyme that causes the hydrolysis of hemicellulose.

As used herein, "pitch" refers to a variety of naturally occurring, hydrophobic, organic resins of low and medium molecular weight in wood fiber that include esters of fatty acids with glycerol (such as the triglycerides), as well as other fats, fatty acids, sterols, and waxes.

As used herein, a "nonionic surfactant" is an organic compound that is amphiphilic and has no charge group at either terminal end group thereof, wherein the organic compound can lower the surface tension of a liquid, the interfacial tension between two liquids, or that between a liquid and a solid.

As used herein, a "poloxamer" refers to a nonionic triblock copolymer that comprises a central block of a hydrophobic polyalkyleneoxide block, which is flanked on both sides with hydrophilic polyalkyleneoxide blocks.

As used herein, "bleaching" refers to removal of color from pulp.

As used herein, "brightness" is a measure of how much light is reflected by paper under specified conditions and is usually reported as a percentage of how much light is reflected. A higher brightness number thus generally represents a brighter or whiter paper, and conversely a lower brightness number represents a less bright or white paper. The ISO standards, or the TAPPI T 452 or T 525 standards, can be used as measures of brightness. Pulps can be formed into handsheets for determinations of brightness thereof according to accepted practices in the paper industry.

As used herein, the "whiteness" of pulp or paper refers to the extent to which paper diffusely reflects light of all wavelengths throughout the visible spectrum, i.e., the magnitude and uniformity of spectral reflectance measured as the percent light reflectance for the whole wavelength range. Procedural standards for the measurement of whiteness are explained in ISO 11475. The L* (luminance) value of CIE L*a*b* colorimetry scale values also can be used herein to indicate the relative whiteness of a pulp or paper. Black has an L* of zero and higher L* values indicate higher whiteness. The a* value relates to redness to greenness, and the b* value relates to yellowness to blueness. Pulps also can be formed into handsheets for determinations of whiteness thereof.

As used herein, "liberating" refers to an activity of a composition in contact with fiber to cause the release of the specified contaminant or contaminants from fiber, such as in the forms of degraded products of hydrolysis, as intact molecular residues, or as other released forms, wherein the content of the contaminant or contaminants in the fiber is reduced by the treatment.

As used herein, "Kappa number" or "Kappa Index" is a measure of the residual lignin content remaining in the cellulosic fiber. Kappa number can be determined for pulps by ISO 302. The presence of the lignin requires that a greater amount of an oxidant (environmental and cost issues) is incurred in order to brighten fiber to a desired point.

It is to be understood that both the foregoing general description and the following detailed description are exemplary and explanatory only and are intended to provide a further explanation of the present invention, as claimed.

The accompanying drawings, which are incorporated in and constitute a part of this application, illustrate some of the embodiments of the present invention and together with the description, serve to explain the principles of the present invention.

DETAILED DESCRIPTION OF THE PRESENT INVENTION

Figure 1:
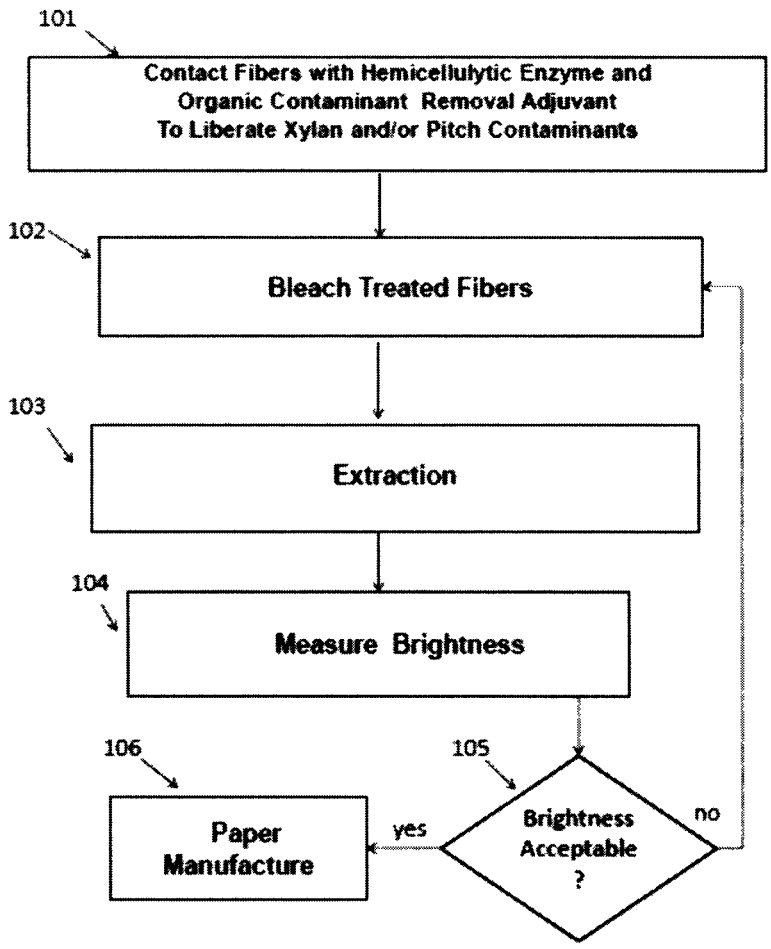
FIG. 1 is a process flow chart showing a method of according to an example of the present application.

The present invention provides enzymatic treatments and compositions therefor that can improve the quality of pulp by removing unwanted materials, wherein these enzymatic activities are unexpectedly enhanced by the use of nonionic surfactants such as described herein. The effects of the compositions of the present invention can comprise, for example, i) removal of xylans/hemicellulose that hold color bodies by using hemicellulases, ii) removal of pitch that cause dirt spots and cause deposits by using lipases or esterases, and/or iii) improvement of the activity and efficacy of many other enzymes, and/or by other effects of the compositions of the present invention.

The present invention provides compositions useful for pretreatments on fiber before bleaching, which enhance liberation and removal of bleach-interfering and/or other interfering substances, such as xylans and pitch components, from the fiber before bleaching. Xylans for example, can be bleach interfering and/or cause other interferences in papermaking systems. Pitch, for example, can be pulp quality compromising or production efficiency-interfering and/or cause other interferences in papermaking systems. The compositions can contain hemicellulolytic enzyme and organic contaminant removal adjuvant, which in combination exert greater bleach-interfering contaminant removal capabilities from fiber than predicted or expected from the individual effects of the components. Further, the pretreatment of wood fiber before bleaching with the indicated compositions of the present invention can increase pulp and paper brightness, whiteness, or both, obtained from bleaching, in magnitudes not predicted from the effects of the individual ingredients. Furthermore, the pretreatment of the wood fiber with the indicated compositions of the present invention can reduce kappa numbers of the treated pulp before bleaching as compared to pulps that are not treated with the compositions. The present inventors further have recognized and solved a need for a pretreatment of wood fiber before bleaching which can increase bleaching for a given quantity of bleaching agent used or, alternatively, permit a similar level of bleaching to be provided using reduced bleaching agent quantities and associated costs. The combination of the organic contaminant removal adjuvant with the hemicellulolytic enzyme in the composition used to pretreat the wood fiber prior to bleaching can increase liberation (separation) and removal of xylans and/or pitch and the like from the wood fiber as compared to the amount freed by pretreatment with composition containing only the enzyme, by at least about 5% by weight, or by a least about 10% by weight, or at least about 20% by weight, or at least about 30% by weight, or at least about 40% by weight, or at least about 50% by weight, or higher amounts, or from about 5% to about 90%, or from about 10% to about 85% by weight, or from about 20% to about 80% by weight, or from about 30% to about 70% by weight, or other amounts. As an option, the present invention can therefore provide a bleach-boosting composition which can save in the oxidizing agent charge (e.g., the chlorine charge) needed to obtain a specified pulp brightness, which can reduce the quantity and cost of the fiber-bleaching agents which are needed and used.

In accordance with the present invention, a method of enhancing enzymatic degradation of a substrate is provided. The method can include adding a polymeric surfactant to an enzyme composition to thereby increase the efficacy of the enzyme in degrading the substrate. Any desired substrate or substrate composition can be treated, for example, paper pulp, paper mill sludge, an animal hide, or the like. Any suitable polymeric surfactant can be used, for example, a nonionic polymeric surfactant. The polymeric surfactant can include a nonionic block copolymer of the type PEO-PPO-PEO, for example, that terminates in primary hydroxyl groups. The nonionic polymeric surfactant can have a hydrophilic-lipophilic balance (HLB) value of at least 17. The nonionic polymeric surfactant can include a propoxylated block copolymer having a HLB value of at least 20.

Any desired enzyme can be used in the compositions of the present invention. For example, the enzyme can include a cellulase, a xylanase, a laccase, an amylase, a lipase, a protease, a peroxidase, or a combination thereof. The substrate composition can be degraded in the presence of the polymeric surfactant and the enzyme to form a degradation product that can optionally be dewatered. The present invention also provides systems for carrying out the described methods and formulations containing an enzyme and a polymeric surfactant for use in the methods.

The methods, formulations, and systems of the present invention have a great number of different utilities; the following are examples of such utilities. Fiber modification can be carried out to reduce refining energy and/or for increasing paper strength. Stickies and pitch can be reduced or eliminated from paper making processes, resulting in better quality paper and reducing shut-down times. Paper mill sludge can be degraded, thus reducing transportation and landfill costs. Pulp mill pre-bleaching can be performed to improve bleaching efficiency. Paper mill sludge can be more effectively dewatered. Enzymatic dehairing and degreasing processes for leather manufacture can be improved. Paper machine boil out and cleaning can be made more efficient. Paper mill felt washing and conditioning can be enhanced. Enzymatic heat exchanger cleaning can be improved.

Any suitable substrate composition can be treated in accordance with the invention. For example, the substrate composition can contain sludge from pulp and/or paper manufacturing and/or from other sources. The substrate composition can comprise biomass. The term "biomass" includes any non-fossilized, i.e., renewable, organic matter. The various types of biomass include plant biomass, microbial biomass, animal biomass (any animal by-product, animal waste, or the like) and municipal waste biomass (residential and light commercial refuse with recyclables such as metal and glass removed). The term biomass also includes virgin or post-consumer cellulosic materials, such as rags and towels fabricated from cotton or a cotton blend. The substrate composition can include, but is not limited to, compositions containing one or more types of fibers of one or more wood types. The substrate composition can contain fibers of one or more lengths, including fines. The substrate composition can include other items, for example, ASA sizing materials or other sizing materials, hydrolyzed sizing materials, polymers, stickies, glues, inks, fillers, other impurities, such as from recycled paper, defoamers, and the like. The substrate composition can be preprocessed before the enzyme degradation and can be further processed after the enzymatic degradation.

The methods of the present invention can be used to convert various kinds of biomass into fuel, feed, and other products. The term "plant biomass" and "lignocellulosic biomass" can include any plant-derived organic matter (woody or non-woody). Plant biomass can include, for example, agricultural or food crops (for example, sugarcane, sugar beets or corn kernels) or an extract therefrom (for example, sugar from sugarcane and corn starch from corn), agricultural crops and agricultural crop wastes and residues such as corn stover, wheat straw, rice straw, sugar cane bagasse, cotton, and the like. Plant biomass can include, for example, trees, woody energy crops, wood wastes and residues such as softwood forest thinnings, barky wastes, sawdust, paper and pulp industry waste streams, wood fiber, and the like. Plant biomass includes grass crops, for example, switchgrass. Plant biomass can include yard waste (for example, grass clippings, leaves, tree clippings, and brush) and vegetable processing waste.

The enzyme and polymeric surfactant for use in the methods of the present invention can be provided separately or together as an enzyme formulation. For example, the enzymatic formulation can contain the enzyme, polymeric surfactant, water, and optional ingredients for formulation stabilization. Stabilizing agents that can be used can include, for example, a polyimide oligomer. The formulations can be incorporated into various products, for example, fiber modification enzyme products, enzyme products for stickies and pitch control, enzyme products for paper mill sludge treatment, enzyme products for water treatment, enzyme products for water treatment, enzyme products for dehairing for leather manufacture, enzymatic degreasing products, pulp prebleaching products, and enzymatic water treatment products for use in swimming pools, cooling towers, and in other contexts.

In accordance with the present invention, the enzymatic activity of the enzyme can be greatly increased by the presence of the polymeric surfactant. For example, the enzymatic activity of the enzyme can be increased by at least 10% compared to just using the enzyme alone without any polymeric surfactant present. This increased activity can be at least 10% greater, at least 20% greater, at least 25% greater, at least 30% greater, at least 35% greater or more, or from about 10% to about 50% greater, in enzymatic activity than in the absence of the polymeric surfactant. These increases can be synergistic between the enzymes and the surfactants, and can significantly outperform products without the enzyme surfactant combination.

The fiber material that is pretreated with the compositions of the present invention before bleaching can be referred to as "pulp" or "fiber pulp." The fiber or pulp that can be pretreated with the compositions of the present invention can be virgin wood fiber, recycled paper (e.g., paper, paperboard, cardboard), or any combinations thereof.

As an option, bleached fibers which have been pretreated with a composition of the present invention can be formed into a paper product which has an ISO Brightness (% ISO) that is from about 0.5 to about 5.0 units or more higher, or from 0.5 to about 1.0 units higher, or from about 0.6 to about 1.0 units higher, or from about 0.7 to about 1.0 units higher, than a paper product produced with the same method without the organic contaminant removal adjuvant included in a composition used to pretreat the wood fiber prior to bleaching (i.e., if the pretreatment composition contains the hemicellulolytic enzyme but not the organic contaminant removal adjuvant). These increases in brightness values can apply to handsheets prepared from the bleached pulp or dried paper made with the bleached pulp. The effect of nonionic surfactant, if used alone in the pretreatment composition, on the ISO brightness values obtained on the fiber by bleaching usually is none, a reduction, or unpredictable. In combination with the hemicellulolytic enzyme, however, the brightness increases significantly over what can be achieved by use of the enzyme alone. Paper products produced with pretreated and bleached fiber according to the methods of the present invention are also provided. The decolored paper products can be provided with an enhanced paper brightness, whiteness, or both, with reduced need of bleaching chemicals, with reduced addition of whitening and brightening additives to the paper stock, or both benefits. As an option, fibers treated with the composition of the present invention can have a Kappa number that is from about 0.2 to about 3.0 units lower, or from about 0.2 to about 1.0 units lower, or from about 0.25 to about 0.95 units lower, or from about 0.3 to about 0.9 units lower, or from about 0.35 to about 0.85 units lower, or from about 0.4 to about 0.8 units lower, or other lower values, than fibers untreated with the composition.

The composition containing the hemicellulolytic enzyme and organic contaminant removal adjuvant components of the present invention can be added jointly or separately to pulp being treated in a papermaking system, as long as they both are added prior to any bleaching of the wood fiber and in manners permitting both components to be substantially uniformly distributed throughout the pulp before commencing bleaching thereon. "Prior to bleaching" can generally mean that the composition of the present invention is added five seconds to thirty minutes to one hour or more before bleaching. For instance, the bleaching step can be immediately the next papermaking process step after treating the pulp fibers with the composition of the present invention. As an option, the hemicellulolytic enzyme and organic removal adjuvant components can be combined in a single composition before use or can be added separately at the same time or almost the same time (within 1 second to 1 hour of each other) and/or can be added sequentially or in any order. As an option, the composition can contain both the indicated components in water-dispersible forms, e.g., as an aqueous pre-blend containing both components. The composition can be added to pulp with sufficient agitation of the aqueous medium containing the pulp to substantially uniformly disperse the introduced components throughout the pulp.

The composition can comprise from about 10% to about 90% by weight of the hemicellulolytic enzyme(s), and from about 1.0% to about 10% by weight of the organic contaminant removal adjuvant(s), based on total solids weight of the composition. The composition can comprise from about 20% to about 80% by weight of the hemicellulolytic enzyme, and from about 2.0% to about 8.0% by weight of the organic contaminant removal adjuvant, based on total solids weight of said composition. The composition can comprise from about 30% to about 70% by weight of the hemicellulolytic enzyme, and from about 3.0% to about 6.0% by weight of the organic contaminant removal adjuvant, on a dry weight basis based on the total dry solids weight of the composition. The composition can be introduced in an amount providing from about 100 to about 1,000 grams of the hemicellulolytic enzyme per ton of the fibers on a dry fiber basis, and from about 2.0 to about 20 grams of the organic contaminant removal adjuvant per ton of the fibers on dry fiber basis. The composition can be introduced in an amount providing from about 200 to about 800 grams of the hemicellulolytic enzyme per ton of the fibers on a dry fiber basis, and from about 4.0 to about 18 grams of the organic contaminant removal adjuvant per ton of the fibers on dry fiber basis. The composition can be introduced in an amount providing from about 400 to about 600 grams of the hemicellulolytic enzyme per ton of the fibers on a dry fiber basis, and from about 5.0 to about 15 grams of the organic contaminant removal adjuvant per ton of the fibers on dry fiber basis.

Referring to the process shown in FIG. 1, the composition containing the hemicellulolytic enzyme and organic contaminant removal adjuvant of the present invention can contact fibers to liberate xylan, pitch, or both from the fibers (step 101). The treated fibers can then be bleached (step 102). The bleached fibers can be extracted with an alkaline material, such as for dissolution of reaction products (step 103). After extraction, the bleached fibers can be evaluated for brightness, such as by measuring the brightness of handsheets prepared with the bleached and extracted fibers (step 104). The measurement of brightness of handsheets is an accepted procedure in the paper industry for evaluating pulp brightness. If the brightness of the fibers is determined to be high enough to meet any applicable specification (step 105), the bleached fibers can be advanced for use in papermaking (processing stage 106). If not, the fibers can be recirculated to the bleaching stage as shown (or alternatively to an earlier pulping stage, which is not shown).

The composition comprising the hemicellulolytic enzyme(s) and organic contaminant removal adjuvant(s) can be added to the fiber at any available addition site prior to bleaching. As an option, the composition can be added to brownstock. Washed brownstock may be stored in a high density storage tower before being pumped into the first bleaching stage. The composition can be added to the pulp as the pulp is pumped into the high density storage tower, and acts on the pulp as it is flowing through this tower. Typically 20 minutes to three hours may elapse before the pulp exits the storage tower. Upon exiting the storage tower, the pulp can be ready to be bleached. The pretreatment with the composition containing both the enzyme and contaminant removal adjuvant makes the pulp more bleachable than if treated by the enzyme alone. The pH of an aqueous medium containing the fiber to be pretreated by the present method can be neutral or alkaline, such as from about 7.0 to about 11.0, or from about 7.0 to about 8.0, or from about 7.0 to about 7.7, or from about 7.1 to about 7.5, or other pH values. Conventional pH modifiers can be used in this respect to pre-adjust the pH of the fiber slurry or other aqueous-dispersed form of the fiber before treatment with the present composition. As an option, conventional agitators can be used to agitate the aqueous fiber material and added composition if held temporarily in tanks or towers during the pretreatment. The pretreatment can be conducted for a time period of at least about 20 minutes, or at least about 30 minutes, or from about 20 minutes to about 180 minutes, or from about 30 minutes to about 120 minutes, or from about 45 minutes to about 90 minutes, or other time periods. As an option, the pretreatment can be conducted at a temperature below any enzyme-deactivating temperature, such as from about 25° C. to about 90° C., or from about 30° C. to about 80° C., or from about 35° C. to about 70° C., or from about 40° C. to about 60° C., or other temperatures. As an option, the pretreatment can be conducted at a temperature below the boiling point of the aqueous medium in which the fiber is slurried or otherwise distributed, and some enzymes also may work above the boiling point of the aqueous medium. As an option, increasingly higher pretreatment temperatures can cause more rapid or extensive effects of liberating xylan, pitch, or both, or other bleach-interfering or otherwise interfering contaminants, from the fibers. After pretreatment with the present compositions, the pretreated fiber or pulp can be directly introduced to a bleaching system. Alternatively, as an option, the pretreated fiber or pulp can be dewatered (e.g., screened, filtered), optionally washed, and reslurried before bleaching.

As an option, the contacting step of the present method, e.g., step 101 illustrated in FIG. 1, removes at least 50% by weight, or at least about 60% by weight, or at least about 70% by weight, or at least about 80% by weight, or at least about 90% by weight, or at least about 95% by weight, or from about 50% to about 99% by weight, or from about 60% to about 95% by weight, or from about 70% to about 90% by weight, of total xylans and pitch components present in the fibers prior to being contacted by the composition.

The bleaching process can use arrangements that include at least one bleaching stage and at least one extraction stage. The bleaching sequences can be based on the use of chlorine or chlorine-containing compounds (e.g., chlorine dioxide, hypochlorites), in one form or another. Chlorine dioxide (denoted "D"), or chlorine (denoted "C"), or ozone (denoted "Z"), or any combinations thereof, such as chlorine dioxide and chlorine, can be used to bleach the pulp, followed by alkaline (caustic) extraction of the bleached pulp in an aqueous alkaline medium. Bleaching agents used on the pretreated pulp can break lignin down into smaller, oxygen-containing molecules and these breakdown products are generally soluble in water, especially if the pH is greater than 7. Many of the reaction products can be carboxylic acids. These materials can be removed between bleaching stages. Extraction stages can be used in this respect in which the bleached pulp is treated with an alkaline solution (e.g., NaOH solution), and then optionally washed before a further bleaching stage. The extraction stage or stages can solubilize and remove a major portion of the chlorinated and oxidized residual lignin, and also may remove some hemicellulose. Washing units optionally can be used between the oxidation and extraction stages, or after completion of the final bleaching stage and before advancement of the bleached pulp to a papermaking system and processing. The chlorine dioxide charge (or chlorine, or chlorine plus chlorine dioxide) in the bleaching stage can be made proportional to the lignin content of the pulp being treated. Oxygen (denoted "O"), oxygen generators such as a peroxide (denoted "P"), or combinations thereof, can be used in combination with the bleaching agent in the bleaching stage or stages. Oxygen, oxygen generators such as hydrogen peroxide, oxygen, or hypochlorite (denoted "H"), or combinations thereof, can be used in combination with the alkaline extraction material in the extraction stage or stages. For the extraction stage or stages, the alkaline extraction material can be used in combination with hydrogen peroxide (denoted "Ep"). The alkaline extraction stage following the bleaching stage may contain other oxidative agents or combinations of the oxidative agents, such as oxidative extraction stages denoted as Eo (oxygen), Epo (peroxide and oxygen), or Eho (hypochlorite and oxygen). The bleaching process can comprise any of the following sequences: Do-Ep; or Do-Washer-Ep; or D-E; or D-Washer-E; or Do-Washer-Ep-Washer-Do-Washer; or Do-Washer-Ep-Washer-Do-Washer-Ep-Do-Washer; C-E; C-Ep; or other sequences.

The hemicellulolytic enzymes that have shown benefit in pretreating wood fiber in combination with an organic contaminant removal adjuvant prior to bleaching include, for example, xylanases and/or mannanases. The hemicellulolytic enzymes can act on the hemicellulose portion of the pulp. Hemicellulose in pulp can have two types of structures with polysaccharide backbones, which are arabinoxylan and glucomannan. Xylanase can be, for example, 1,4-beta-D-xylan-xylohydrolase (E.C. 3.2.1.8) that catalyzes the endo-hydrolysis of 1,4-beta-D-xylosidic linkages in xylans. Xylanase can have xylan degrading activity, pitch liberating activity, or both, in the co-presence of the organic contaminant removal adjuvant. The term "xylan degrading activity," as used herein can be, for example, a biological activity that hydrolyzes xylan-containing material. The mannanases can be, for example, endo-mannanases, such as endo-β-mannanase. Mannanase can have activity contributing to xylan liberation, pitch liberating activity, or both, in the co-presence of the organic contaminant removal adjuvant.

The hemicellulolytic enzymes can be used singly or in combinations with each other or with different types of enzymes. Other optionally used enzymes include those having lipolytic activity, such as lipase, esterase, cutinase, individually or in any combinations thereof. The effect of the inclusion of lipase or other lipolytic enzyme in the compositions of the present invention can be, for example, to increase hydrolysis of triglycerides associated with pitch components. If included, lipase or other lipolytic enzyme can be used in an amount sufficient for this effect, such as in similar concentrations as indicated herein for the hemicellulolytic enzymes.

The hemicellulolytic enzymes can be extracted, for example, from various fungi, and other vegetable tissues, and may be produced by fermentation of selected microorganisms. For example, the xylanases can be obtained by fermentation of a strain of fungus of the species *Aspergillis awamori* or by fermentation of bacterial strains of *Streptomyces olivochromogenes* or *Bacillus subtilis*, or from other fermentation processes. Mannanase preparations, for example, are commercially available, including types which may be manufactured with the aid of genetically modified microorganisms (e.g., *Bacillus*- and *Trichoderma*-types). The hemicellulolytic enzymes can be commercially obtained in ready-to-use preparations, from suppliers such as Novozymes A/S (Bagsvaerd, Denmark), or Dyadic International (Jupiter, Fla.), or Iogen Corporation (Ottawa, Ontario, Canada). The enzymes can be a dry powder or granulate, a non-dusting granulate, a liquid, a stabilized liquid, or a stabilized protected enzyme, or other forms suitable for addition to a fiber slurry or similar fiber-containing material. Liquid enzyme preparations may, for instance, be stabilized by adding stabilizers such as a sugar, a sugar alcohol or another polyol, and/or lactic acid or another organic acid according to established processes. Dry powder forms may be lyophilized and include substrates. If enzyme substrates are present with dry powder forms of the enzymes, the substrates should not adversely interact with or interfere with the fiber processing stages, such as bleaching, extraction, or papermaking processes. The lipolytic enzymes, if used, can be obtained and used similarly.

The methods, formulations, and systems of the present invention can use any suitable enzyme or combination of two or more enzymes. One or more enzymes classified by The International Union of Biochemistry and Molecular Biology can be used, including oxidoreductases (EC1) for catalyzing oxidation/reduction reactions, transferases (EC2) for catalyzing transfer of a functional group, hydrolases (EC3) for catalyzing the hydrolysis of various bonds, lyases (EC4) for catalyzing the cleavage of various bonds by means other than hydrolysis and oxidation, isomerases (EC5) for catalyzing the isomerization changes within a single molecule, and ligases (EC6) for catalyzing the joinder of two molecules with covalent bonds.

Many other enzymes can also be used in the present invention. Enzymes for producing bulk products, such as glucose and fructose, for food processing, for detergents, and for the textile, pulp and paper, and animal feed industries can be used. Food production enzymes can be used. Amylases from fungi and plants can be used in the production of sugars from starch, for example in the manufacture of high-fructose corn syrup, and in baking. Proteases can be used to lower the protein content of flour for making various baked goods. Trypsin can be used to predigest baby foods. Brewing and fermentation enzymes can be used, for example, barley enzymes, amylase, glucanase, protease, betaglucanase, arabinoxylanase, amyloglucosidases, pullulanases, cysteine endopeptidases, glucoamylases, and acetolactatatecarboxylase. Cellulases and pectinases can be used in the clarification of fruit juices. Dairy industry enzymes can be used, for example, renin and coagulating enzymes for the manufacture of cheese, lipases for ripening of cheese, lactase for breaking down lactose in dairy compositions, hydrolysates, transglutaminases, and beta-galactosidases. Papain can be used for meat tenderizing. Enzymes for converting starch into sugars and sweeteners, for example, amylase, amyloglucosidase, glucoamylase, and glucose isomerase can be used. Paper industry enzymes, for example, amylases, xylanases, cellulases, hemicellulases, laccases, and ligninases can be used. Examples of enzymes include lipase for stickies control, xylanase for prebleaching, and cellulase for fiber modification. Biofuel enzymes, for example, cellulases for breaking down cellulose for fermentation, and lignases can be used. Proteases for cleaning contact lenses and recycling film can be used. Catalase for converting latex into foam rubber can be used. Restriction enzymes, ligases, and polymerases can be used in biotechnological applications. Proteases can be used to remove hair from, and lipases to remove grease from, animal hides in the leather industry. Detergent enzymes, for example, proteases, amylases, lipases, cellulases, and mannanases can be used. Textile enzymes can be used for desizing of fibers, degumming silk, bleaching fibers, and aging denim. Enzymes for oil-field, wastewater, and polymerization applications can also be used.

The enzyme or the formulation containing the enzyme (e.g., a pre-formed formulation containing the enzyme and polymeric surfactant of the present invention) can have an enzymatic activity of at least 10 units/g. For example, the enzyme or the composition containing the enzyme can have an enzymatic activity of at least 15 units/g, at least 20 units/g, at least 25 units/g, at least 100 units/g, or at least 500 units/g, for instance, from 10 units/g to 1,500 units/g or higher.

The enzyme can be present in any suitable amount or concentration based on the target substrate or substrate composition. For example, the enzyme can be present in a concentration of from about 0.05 wt. % to about 5 wt. %, based on the total weight of an enzyme formulation containing at least the enzyme and the polymeric surfactant. For example, the concentration of the enzyme can be from 0.1 wt. % to 35 wt. %, from 0.5 wt. % to 35 wt. %, from 1.0 wt. % to 35 wt. %, from 2 wt. % to 35 wt. %, from 5 wt. % to 35 wt. %, from 10 wt. % to 35 wt. %, from 15 wt. % to 35 wt. %, from 20 wt. % to 35 wt. %, or more, based on the total weight of the enzyme formulation. When a given amount of water is present in the enzyme formulation, these percentages are reduced proportionally by a dilution factor. Once the enzyme formulation is added to the substrate composition, the percentages are again reduced by a dilution factor.

As indicated, measurement of brightness and whiteness values of fiber treated with compositions of the present invention can be used to evaluate the pretreatment effects of the enzyme and organic contaminant removal adjuvant-containing compositions of the present invention on bleaching of the fiber. Methods for evaluating xylan degrading activity by compositions of the present invention on fiber before bleaching also may be measured, for example, by determining the reducing sugars formed from various types of xylan, or by colorimetric determination of carbohydrates, as shown, for example, in U.S. Patent Application Publication No. 2011/0078830 A1, which is incorporated herein by reference in its entirety, or by adaption of other conventional methods which are used for evaluating xylanolytic type activity.

The polymeric surfactant can be at least one poloxamer. The polymeric surfactant can be a block copolymer of the type PEO-PPO-PEO. To avoid any doubt, the descriptions (and examples provided herein) regarding surfactant and organic contaminant removal adjuvant apply equally to each other and are interchangeable.

Figures 2, 3:
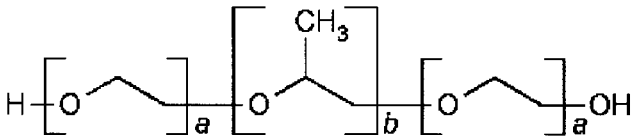
FIG. 2 is a structure of a poloxamer which can be used in a composition according to an example of the present application.
FIG. 3 is a table of data showing different compositions containing different additives or none (Control) used to pretreat wood fiber pulps before a bleaching process, and the brightness (% ISO), brightness increase, and CIE L*a*b* scale values determined for the pulps after a chlorine bleaching stage D and extraction stage Ep, wherein pulps were treated with a composition containing xylanase and nonionic surfactant according to examples of the present application ("XylA+Surf", "XylB+Surf"), and other comparison pulps were pretreated with xylanase alone ("XylA", "XylB"), or a commercial enzyme complex ("LBL CONC"), or with no enzyme or surfactant additives (Control).

The organic contaminant removal adjuvant can be at least one nonionic surfactant. The nonionic surfactant can be at least one poloxamer. Poloxamers can be nonionic triblock copolymers that comprise a central block of a hydrophobic polyalkyleneoxide block, which is flanked on both sides with hydrophilic polyalkyleneoxide blocks. The polyalkyleneoxide blocks of the poloxamers can independently comprise lower alkylene oxide chains, such as $C_2$, $C_3$, or $C_4$ alkylene oxide chains. As an option, the poloxamer can comprise a central block of polypropyleneoxide (PPO) or polybutyleneoxide (PBO), sandwiched between two blocks of polyethylene oxide (PEO). The poloxamers can be PEO-PPO-PEO copolymers which can have the general formula I: $HO(C_2H_4O)_a(C_3H_6O)_b(C_2H_4O)_aH$, where a and b are the respective average number of EO and PO monomer units in the applicable PEO and PPO block. The PEO-PPO-PEO structure can be a difunctional block copolymer surfactant which terminates in primary hydroxyl groups. A structure of a poloxamer which can be used is shown in FIG. 2. Because of their amphiphilic structure, the poloxamers can have nonionic (i.e., no charge) surfactant properties.

Poloxamers can be synthesized sequentially. For example, a central block can be polymerized first from PO to form PPO, then outer PEO blocks can be added to the ends of the central PPO block in a second polymerization step using EO. Commercial sources of poloxamers are, for example, PLURONIC® copolymers from BASF Corporation (Florham Park, N.J., U.S.A.). These compounds are commonly named with the word Poloxamer followed by a number to indicate the specific co-polymer, for example, Poloxamer 407 having two PEG blocks of about 101 units ($y^1$ and $y^3$ each equal to 101) and a polypropylene block of about 56 units. This polymer is available from BASF under the trade name LUTROL™ F-17. In BASF's PLURONIC® code, the alphabetical designation can be derived from the physical form of the product at room temperature: L for liquids, P for pastes, and F for flake (solid) forms. In the numerical designation, the last digit multiplied by 10 may indicate the approximate percentage (w/w) of the hydrophilic portions in the PLURONIC® copolymer. Commercial names of the poloxamer which can be used in the present methods and compositions can include, for example, PLURONIC® F38, PLURONIC® F68, PLURONIC® F88, PLURONIC® F98, PLURONIC® F108, PLURONIC® F87, PLURONIC® P105, and PLURONIC® F127. PLURONIC® F108, for example, can comprise about 80% PEO (total):about 20% PPO on a weight: weight (w/w) basis, and an average molecular weight of about 14,600 g/mol. Liquid ethylene oxide, propylene oxide block copolymer formulations, for example, PLURAFLO® L 1060 and PLURAFLO® L 1220, available from BASF, can be used. The physical properties of the poloxamers can range from low-viscosity liquids to pastes to solid, depending upon the precise combination of molecular weight and PEO:PPO ratio. The mass ratio of total PEO to the PPO can be from about 1:9 to about 9:1, or from about 1:9 to about 8:2, or from about 2:8 to about 8:2, or from about 2.5:7.5 to about 7.5:2.5, or from about 4:6 to about 6:4, or other values. The PEO proportion can comprise at least a predominant amount (i.e., ≥50%) of the total PEO and PPO content of the poloxamer on a mass basis. A poloxamer which can be used can comprise a PEO:PPO ratio, on a weight:weight (w/w) basis, of from about 50:50: to about 95:5, or from about 60:40 to about 90:10, or from about 75:25 to about 85:15, or from about 78:22 to about 82:18, or about 80:20, or other values. The poloxamers in general can have molecular weights, for example, of from about 1,000 g/mol to about 25,000 g/mol, or from about 2,500 to about 22,500 g/mol, or from about 5,000 g/mol to about 20,000 g/mol, or from about 7,500 g/mol to about 18,000 g/mol, or from about 10,000 g/mol to about 16,000 g/mol, or from about 12,000 g/mol to about 15,000 g/mol, from about 12,000 g/mol to about 17,000 g/mol, from about 13,500 g/mol to about 16,000 g/mol, or of about 15,000 g/mol, or other values.

The water solubility of nonionic surfactants such as poloxamers can be related to their hydrophilic-lipophilic balance (HLB) value or number. HLB values can be calculated by known means in the art, for example, see "The HLB System," ICI Americas, Inc., 1980. HLB values can be calculated for molecules, for example, surfactants and emulsifiers that have hydrophilic and/or lipophilic characteristics. HLB values can be determined theoretically, experimentally, and/or otherwise estimated. The HLB value can correspond to the percentage weight of the hydrophilic portion of the molecule divided by a factor of five so that a 100% hydrophilic molecule would have an HLB value of 20. For example, a poloxamer containing 80 mole % PEO (total) would have an HLB value calculated to be 16 (i.e., 80/5=16). HLB values that exceed 20 are relative or comparative values. The percentage of the molecule that is hydrophilic can be determined theoretically by dividing the molecular weight of the hydrophilic portion of the molecule by the total molecular weight of the molecule. HLB values of the polymeric surfactants used in the present invention can be at least about 15, at least about 16, at least about 17, at least about at least about 19, at least about 20, at least about 22, at least about 24, at least about 25, at least about 26, at least about 28, at least about 30, at least about 32, at least about 35, at least about 40, or at least about 50. Other polymeric surfactants that can be used can have HLB values less than about 15. Nonionic surfactants, cationic surfactants, anionic surfactants, zwiterionic surfactants, amphiphilic surfactants, or combinations thereof can be used. In addition to the polymeric surfactant, non-polymeric surfactants can also be used.

The presence of the hydrophilic PEO terminal portions in the poloxamers means that the surfactant molecules normally have a HLB value which is greater than zero, i.e., they have some hydrophilic character. PPO can have an HLB value close to zero, e.g., less than 0.5. Where the PEO content of the poloxamers comprises a predominant amount of the copolymer, the hydrophilic character of the copolymer can be expected to be more than the molecule's lipophilic character. The HLB values of poloxamers which contain a predominant amount of PEO can be, for example, at least about 10, or at least about 11, or at least about 12, or at least about 13, or at least about 14, or at least about 15, or at least about 16, or at least about 17, or at least about 18, or at least about 19, or from about 10 to about 19.9, or from about 11 to about 19, or from about 12 to about 18, or from about 13 to about 17.5, or from about 14 to about 17, or other values. HLB values can be estimated by experimental methods, so that their HLB values are aligned or normalized with one or more molecule having a known HLB value. An experimental method of HLB determination can involve blending the unknown molecule in varying ratios with a molecule of known HLB, and using the blend to emulsify an oil having a known required HLB. The blend that performs best can be taken to have an HLB value approximately equal to the required HLB of the oil. The HLB value of the unknown can then be calculated. The experimental procedure can be repeated and the average taken. HLB values can also be estimated from the water-solubility or dispersibility of a molecule.

The amount of the polymeric surfactant used can be, for example, an amount of from about 0.5 wt. % to about 30 wt. %, from about 0.5 wt. % to about 15 wt. %, from about 1.0 wt. % to about 25 wt. %, from about 1.0 wt. % to about 10 wt. %, from about 2.5 wt. % to about 20 wt. %, from about 5.0 wt. % to about 15 wt. %, from about 7.5 wt. % to about 17.5 wt. %, or from about 10 wt. % to about 15 wt. %, based on the total weight of an enzyme formulation. The polymeric surfactant can be present in an amount of at least 0.1% by weight, at least 0.5 wt. %, at least 1.0 wt. %, at least 5.0 wt. %, or at least 10 wt. %, based on the total weight of the substrate or substrate composition. The enzyme and the polymeric surfactant can be present in a weight ratio of enzyme to nonionic polymeric surfactant of from about 0.01:10 to about 10:0.01, or from about 0.1:10 to about 10:0.1, or from about 0.5:5.0 to about 5.0:0.5, or from about 1.0:2.0 to about 2.0:1.0.

When formulated into an enzyme formulation that can be used to treat a substrate, the enzyme formulation can include the enzyme, the polymeric surfactant, water, and other ingredients for formula stabilization. The dosages of the enzyme formulation that can be used can be, for example, from about 0.01 to about 10.0 pound (lb.)/ton dry substrate, from about 0.1 to about 5.0 lb./ton dry substrate, from about 0.25 to about 2.5 lb./ton dry substrate, or from about 0.5 to about 2.0 lb./ton dry substrate. The same dosage amounts can be used if the enzyme is added alone, without the surfactant. If the enzyme and surfactant are added separately, the amount of surfactant dosing can be, for example, from about 0.001 to about 5.0 lb./ton dry substrate, from about 0.0015 to about 3.0 lb./ton dry substrate, from about 0.01 to about 1.0 lb./ton dry substrate, or from about 0.025 to about 0.75 lb./ton dry substrate.

Any suitable polymeric surfactant, nonionic or otherwise, can be used. For example, poly(ethylene glycol, including ester derivatives thereof, such as its methyl ester or the esters of fatty acids (e.g., PEG-palmitate). Block polymers of the type PEO-PPO-PEO, and random PEO-PPO polymers can be used. TRITON-X-100 (polyethylene glycol p-(1,1,3,3-tetramethylbutyl)-phenyl ether), which is a nonionic surfactant that contains a polyethylene glycol moiety, can be used. Examples of just a few of the polymeric surfactants that can be used include the following: polyoxyethylenesorbitan monopalmitate (TWEEN 40); polyethylene glycol sorbitan monolaurate, polyoxyethylenesorbitan monolaurate (TWEEN 20); TERGITOL 15-S-20; TERGITOL 15-S-30; TERGITOL 15-S-40; poly(ethylene glycol)-block-poly(propylene glycol)-block-poly(ethylene glycol) (PEG-PPG-PEG, PLURONIC® F-68); poly(ethylene glycol)-block-poly (propylene glycol)-block-poly(ethylene glycol) (PEG-PPG-PEG, PLURONIC® F-108); polyoxyethylene (150) dinonylphenyl ether, polyoxyethylene, dinonylphenyl and nonylphenyl ethers, branched (IGEPAL®) DM-970); polyoxyethylene (100) stearyl ether (BRIJ® S 100), poly(ethylene glycol)-block-poly(propylene glycol)-block-poly(ethylene glycol) (PEG-PPG-PEG, Pluronic® L-35); polyoxyethylene (40) nonylphenyl ether, branched (IGEPAL® CO-890); and polyethylene glycol hexadecyl ether, polyoxyethylene (20) cetyl ether (BRIJ® 58). These surfactants are available from Sigma-Aldrich (St. Louis, Mo.), except for the TERGITOL surfactants, which are available from Dow Chemical (Midland, Mich.). The polymeric surfactant can have an average molecular weight (in Daltons) of from 1,000 to about 20,000, for instance, from about 2,000 to about 15,000, from about 3,000 to about 12,000, from about 5,000 to about 20,000, from about 10,000 to about 20,000, from about 12,000 to about 17,000, from about 13,500 to about 16,000, at least about 20,000, at least about 50,000, at least about 100,000, or at least about 500,000. The fiber that can be treated by compositions of the present invention before bleaching is not necessarily limited. As indicated, the fiber can be in pulp form, although not limited thereto. The wood fiber can be a particulated form of a wood fiber source that is slurried, dispersed, or suspended in an aqueous medium. As indicated, the pulp can be virgin wood fiber pulp, recycled fiber pulp, or any combination thereof. The wood fiber can be hardwood, softwood, or any combinations thereof. The pulp to be treated can be, for example, kraft pulp, sulfite pulp, sulfate pulp, soda pulp, mechanical pulp, thermomechanical pulp, chemothermomechanical pulp, recycled paper pulp, or any combination thereof. Typical pulp slurries in paper applications can contain, for example, from about 0.2 to about 18% by weight of organic matter, based upon 100% total weight of slurry. The organic matter is typically comprised of wood fiber (or pulp) and any additives. Generally, the organic matter comprises from about 90% to about 99% by weight of wood fiber (or pulp), based upon 100% total weight of organic matter. The fiber can at least partially be derived from recycled paper, e.g., at least 5%, or at least 10%, or at least 25%, or at least 50%, or at least 75% by weight recycled paper based on total fiber used on a dry weight basis. The pulp slurry may also contain additives known in the art. Examples of such additives include, but are not limited to, algaecides; sodium hydroxide (or other caustic); peroxide stabilizers, such as sodium silicate, magnesium sulfate, and polyphosphates; chelating agents, such as EDTA; fatty acids; and any combinations thereof. The optional additives, if used, should not interfere with the indicated action of the pretreatment compositions of the present invention, or the bleaching process or other downstream processes.

Paper products produced with pretreated and bleached fiber according to the methods of the present invention are also provided. The decolored paper products can be, for example, printable or inkable paper sheets, sheets for cardboard construction, tissue paper, hygiene and personal care sheet or liner materials, and other paper-based products. The paper products made by methods of the present invention can achieve the same ISO % brightness as comparison paper products made with (a) more extensive bleaching, and thus more costly bleaching, or (b) as modified during papermaking to contain greater amounts of extraneously added brightening or whitening additives, and thus more costly additive needs. Conventional brightening or whitening additives that have been used in papermaking, include, for example, mineral whiteners (e.g., titanium dioxide, barium sulfate), and organic brighteners (e.g., fluorescent whiteners/brighteners). A reduction in the quantities of use of these additives can reduce cost. As an option, paper products made by methods using compositions of the present invention in fiber pretreatments before bleaching can achieve the same ISO % brightness with reduced total brightening or whitening additives added during papermaking as paper products made without the pretreatment with the present compositions. As an option, paper products made by methods using compositions of the present invention in fiber pretreatments before bleaching can reduce the total amount of brightening or whitening additives needed to obtain a specified brightness by at least about 5% by weight, or at least about 10% by weight, or at least about 15% by weight, or at least about 20% by weight, or other amounts. For example, if titanium dioxide was added to the paper during papermaking to provide paper having a ISO % brightness of 78.0, the addition of the pretreatment of the present invention can reduce the titanium dioxide requirements for obtaining that same brightness by at least about 5.0% by weight or more.

In addition to the enzyme and the polymeric surfactant, other components can be used in addition, such as preservatives, stabilizing agents, deodorants, fillers, extenders, and the like. For example, at least one stabilizer can be used, such as a PVP, with or without glycerol. Further, one or more salts can be present, such as calcium chloride or other salts. The enzyme and polymeric surfactant can be diluted or prepared in water or other aqueous solutions. For example, the glycerol or similar component can be present in an amount of 5.0 wt. % to about 30 wt. % based on the total weight of an enzyme formulation (without dilution with water). The PVP, such as PVP K90 or similar component, can be present in an amount of from about 1.0 wt. % to about 10 wt. % based on the total weight of the enzyme formulation (without dilution with water). The $CaCl_2$ or similar component can be present in an amount of from about 0.1 wt. % to about 2.0 wt. % based on the total weight of the enzyme formulation (without dilution with water). A preservative, such as BUSAN® 1078, can be present in an amount of from 0.05 wt. % to about 0.2 wt. % based on the total weight of the enzyme formulation (without dilution with water).

Biocides can be used to preserve the formulations of the present invention for storage purposes. Biocides that can be used include, for example, biocides from Buckman Laboratories International, such as BUSAN® 1078. If biocides are present, the amounts can be below 1.0 wt. %, less than 0.5 wt. %, less than 0.1 wt. %, or from about 0.001 wt. % to about 0.01 wt. % based on the overall weight of the components present that form the enzyme formulation (without dilution with water), or based on the dry substrate weight.

In the present invention, the enzyme, polymeric surfactant, and any optional components can be added together as a pre-formed enzyme formulation or each individual component or any combination of components can be added separately, such as sequentially, batch-wise, or at the same time through different inlet injection points. The enzyme formulation or components thereof can be introduced incrementally over any time period, for example, from about 10 seconds to about 150 hours or more, can be introduced periodically, or can be introduced all at one time. Addition of the polymeric surfactant and the enzyme can be simultaneous, sequential, or alternating. For example, the addition of the enzyme and polymeric surfactant can be within 10 seconds of each other, within 1 minute of each other, within 10 minutes of each other, within 30 minutes of each other, within 1 hour of each other, within 6 hours of each other or within 12 hours of each other, in any order. An enzyme formulation can be prepared by mixing the components together in any order. Water or an aqueous component or solution can be used to form the enzyme formulation. The water or aqueous solution or component can be present in an amount of from about 10 wt. % to about 90 wt. %, based on the total weight of the enzyme formulation diluted with water.

The enzymatic formulation of the present invention or the components that form the enzyme formulation of the present invention can be applied or introduced to the substrate or substrate composition in any manner, such as by spraying, pouring, injecting, mixing in, and the like. Any contact technique to bring the components of the enzyme formulation of the present invention into contact with the substrate or substrate composition, can be used. The enzyme formulation or the components that make up the enzyme formulation can be subsequently mixed with the substrate composition or otherwise dispersed in the substrate composition in order to improve the degradation rate. The enzyme formulation can be in liquid form, solid form, dry form, tablet form, or semi-solid form. The enzyme formulation can be incorporated or present in a cartridge, or can be present in a membrane or filter or on any surface that contacts the substrate composition.

The enzyme formulation of the present invention or components that make up the enzyme formulation can be introduced to the substrate composition in a tank, in a settling pond, and/or in another containment location. The water content of the substrate composition that is being treated can be any water content, such as from about 1.0 wt. % to about 99 wt. % based on the total (wet) weight of the substrate composition.

In accordance with the present invention, after the enzyme and polymeric surfactant are brought into contact with the substrate composition, treatment can last for any suitable contact time. For example, the contact time can be from about 30 minutes to about 48 hours or more, or from 1.0 hour to about 150 hours or more. In other examples, the contact time can be from 5.0 hours to 100 hours, from about 10 hours to about 75 hours, from about 24 hours to about 72 hours, or at least about 48 hours or more. Contact time can be based on the particular process used at the location of the substrate composition. Reactions conditions for the degradation can be variable or constant with respect to pH, temperature, or any other relevant parameter. The degradation can be performed at a temperature of from about 5° C. to about 95° C., from about 15° C. to about 80° C., from about 25° C. to about 60° C., or from about 35° C. to about 50° C. The pH of the substrate composition, including the added enzyme and polymeric surfactant, can be from about 2.0 to about 12, from about 4.0 to about 10, or from about 6.0 to about 8.0. After the contact time, de-watering of the degradation product can occur. Any method that is known in the art to de-water the degradation product can be used. For instance, the de-watering can be achieved by using a settling tank or pond and then pressing, extruding, filtering, centrifuging, and the like.

The present invention includes the following aspects/embodiments/features in any order and/or in any combination:

1. A method for controlling organic contaminants which interfere with bleaching of fibers in papermaking systems, comprising:

a) contacting, prior to any bleaching step, the fibers with a composition comprising at least one hemicellulolytic enzyme and at least one organic contaminant removal adjuvant to provide treated fibers from which organic contaminants liberate from the fibers in greater amount than wherein the fibers are contacted with the composition without said organic contaminant removal adjuvant, wherein the organic contaminants comprise one or more xylans, one or more pitch components, or both; and b) bleaching the treated fibers to form bleached fibers.

2. The method of any preceding or following embodiment/feature/aspect, further comprising:

c) forming the bleached fibers into a paper product.

3. The method of any preceding or following embodiment/feature/aspect, wherein the paper product has an ISO Brightness that is from about 0.5 units to about 5.0 units higher than a paper product produced with the method without said organic contaminant removal adjuvant included in the composition.

4. The method of any preceding or following embodiment/feature/aspect, wherein said contacting removes at least 50% by weight of total xylans and pitch components present in the fibers prior to said contacting.

5. The method of any preceding or following embodiment/feature/aspect, wherein said bleaching comprises contacting the treated fibers with a bleaching agent that is chlorine dioxide, hydrogen peroxide, oxygen, elemental chlorine, hypochlorite, ozone, or any combinations thereof.

6. The method of any preceding or following embodiment/feature/aspect, wherein said organic contaminant removal adjuvant is at least one nonionic surfactant.

7. The method of any preceding or following embodiment/feature/aspect, wherein said organic contaminant removal adjuvant is a poloxamer.

8. The method of any preceding or following embodiment/feature/aspect, wherein said organic contaminant removal adjuvant is a poloxamer having an HLB value of 16 or more.

9. The method of any preceding or following embodiment/feature/aspect, wherein the hemicellulolytic enzyme is xylanase, mannanase, or both.

10. The method of any preceding or following embodiment/feature/aspect, wherein the composition further comprises a lipolytic enzyme.

11. The method of any preceding or following embodiment/feature/aspect, wherein the composition further comprises a lipolytic enzyme that is lipase, esterase, cutinase, or any combinations thereof.

12. The method of any preceding or following embodiment/feature/aspect, wherein said composition is introduced in an amount providing from about 100 to about 1,000 grams of said hemicellulolytic enzyme per ton of said fibers on a dry fiber basis, and from about 2.0 to about 100 grams of said organic contaminant removal adjuvant per ton of said fibers on dry fiber basis.

13. The method of any preceding or following embodiment/feature/aspect, wherein the fibers treated with the composition have a Kappa number that is from about 0.2 to about 3.0 units lower than fibers untreated with the composition.

14. A composition comprising a hemicellulolytic enzyme and an organic contaminant removal adjuvant capable of removing organic contaminants comprising one or more xylans, one or more pitch components, or both, from fibers in a greater amount than wherein the fibers are contacted with the composition without said organic contaminant removal adjuvant.

15. The composition of any preceding or following embodiment/feature/aspect, wherein the organic contaminant removal adjuvant is a nonionic surfactant.

16. The composition of any preceding or following embodiment/feature/aspect, wherein the organic contaminant removal adjuvant is a poloxamer.

17. The composition of any preceding or following embodiment/feature/aspect, wherein the organic contaminant removal adjuvant is a poloxamer having an HLB value of 16 or more.

18. The composition of any preceding or following embodiment/feature/aspect, wherein the hemicellulolytic enzyme is xylanase, or mannanase, or any combinations thereof.

19. The composition of any preceding or following embodiment/feature/aspect, wherein the composition further comprises a lipolytic enzyme.

20. The composition of any preceding or following embodiment/feature/aspect, wherein composition comprises from about 10% to about 90% by weight of said hemicellulolytic enzyme, and from about 1.0% to about 10% of said organic contaminant removal adjuvant, based on total solids weight of said composition.

21. A paper product of the method of any preceding or following embodiment/feature/aspect.

22. A paper product containing the composition of any preceding or following embodiment/feature/aspect.

23. A method of enhancing enzymatic degradation of a substrate comprising:

adding at least one nonionic polymeric surfactant to a substrate composition, the surfactant having a hydrophilic-lipophilic balance (HLB) of at least 17;

adding at least one enzyme to the substrate composition, the enzyme comprising a cellulase, a xylanase, a laccase, an amylase, a lipase, a protease, a peroxidase, or any combinations thereof; and degrading the substrate composition in the presence of the nonionic polymeric surfactant and enzyme to form a degradation product.

24. The method of any preceding or following embodiment/feature/aspect, wherein the nonionic polymeric surfactant is present in an amount of at least 0.1% by weight based on the total weight of the substrate composition.

25. The method of any preceding or following embodiment/feature/aspect, wherein the enzyme and the nonionic polymeric surfactant are present in a weight ratio of enzyme to nonionic polymeric surfactant of from 0.01:10 to 10:0.01.

26. The method of any preceding or following embodiment/feature/aspect, wherein an enzymatic activity of the enzyme in the presence of the nonionic polymeric surfactant is at least 10% greater than the enzymatic activity of the enzyme alone.

27. The method of any preceding or following embodiment/feature/aspect, wherein the degrading is performed at a temperature of from about 5° C. to about 80° C.

28. The method of any preceding or following embodiment/feature/aspect, wherein the nonionic polymeric surfactant is a block copolymer of the type PEO-PPO-PEO.

29. The method of any preceding or following embodiment/feature/aspect, wherein the HLB is from about 22 to about 30.

30. The method of any preceding or following embodiment/feature/aspect, wherein the nonionic polymeric surfactant and the enzyme are added sequentially within 30 minutes of each other in any order.

31. The method of any preceding or following embodiment/feature/aspect, wherein the nonionic polymeric surfactant has an average molecular weight of from about 12,000 Daltons to about 17,000 Daltons.

32. The method of any preceding or following embodiment/feature/aspect, wherein the substrate composition comprises paper pulp, paper mill sludge, or an animal hide.

33. A method of enhancing enzymatic degradation of a substrate comprising: adding a polymeric surfactant to a substrate composition, the polymeric surfactant comprising a nonionic block copolymer of the type PEO-PPO-PEO terminating in primary hydroxyl groups; adding an enzyme to the substrate composition comprising a xylanase, a laccase, an amylase, a protease, a peroxidase, or any combinations thereof; and degrading the substrate composition in the presence of the polymeric surfactant and enzyme to form a degradation product.

34. The method of any preceding or following embodiment/feature/aspect, wherein the polymeric surfactant is present in an amount of at least 0.1% by weight based of the total weight of the substrate composition.

35. The method of any preceding or following embodiment/feature/aspect, wherein the enzyme and the polymeric surfactant are present in a weight ratio of enzyme to nonionic polymeric surfactant of from 0.1:10 to 10:0.1.

36. The method of any preceding or following embodiment/feature/aspect, wherein an enzymatic activity of the enzyme in the presence of the polymeric surfactant is at least 10% greater than the enzymatic activity of the enzyme alone.

37. The method of any preceding or following embodiment/feature/aspect, wherein the degrading is performed at a temperature of from about 5° C. to about 80° C.

38. The method of any preceding or following embodiment/feature/aspect, wherein the polymeric surfactant exhibits an HLB of at least 20.

39. The method of any preceding or following embodiment/feature/aspect, wherein the HLB is from about 22 to about 30.

40. The method of any preceding or following embodiment/feature/aspect, wherein the polymeric surfactant and the enzyme are added sequentially within 30 minutes of each other, in any order.

41. The method of any preceding or following embodiment/feature/aspect, wherein the polymeric surfactant has an average molecular weight of from about 12,000 to about 17,000.

42. The method of any preceding or following embodiment/feature/aspect, wherein the substrate composition comprises fibers, paper pulp, paper mill sludge, or an animal hide.

43. The method of any preceding or following embodiment/feature/aspect, further comprising dewatering the degradation product.

44. A method of enhancing enzymatic degradation of a substrate comprising: adding at least one nonionic polymeric surfactant to a substrate composition, the nonionic polymeric surfactant comprising at least one propoxylated block copolymer having a hydrophilic-lipophilic balance (HLB) of at least 20;

adding at least one enzyme to the substrate composition; and degrading the substrate composition in the presence of the nonionic polymeric surfactant and enzyme to form a degradation product.

45. The method of any preceding or following embodiment/feature/aspect, wherein the nonionic polymeric surfactant is present in an amount of at least 0.1% by weight based on the total weight of the substrate composition.

46. The method of any preceding or following embodiment/feature/aspect, wherein the enzyme and the nonionic polymeric surfactant are present in a weight ratio of enzyme to polymeric surfactant of from 0.1:10 to 10:0.1.

47. The method of any preceding or following embodiment/feature/aspect, wherein an enzymatic activity of the enzyme in the presence of the nonionic polymeric surfactant is at least 10% greater than the enzymatic activity of the enzyme alone.

48. The method of any preceding or following embodiment/feature/aspect, wherein the HLB is from about 22 to about 30.

49. The method of any preceding or following embodiment/feature/aspect, wherein the nonionic polymeric surfactant has an average molecular weight of from about 13,500 to about 16,000.

50. The method of any preceding or following embodiment/feature/aspect, wherein the substrate composition comprises paper pulp, paper mill sludge, or an animal hide.

51. The method of any preceding or following embodiment/feature/aspect, further comprising dewatering the degradation product.

The present invention can include any combination of these various features or embodiments above and/or below as set forth in sentences and/or paragraphs. Any combination of disclosed features herein is considered part of the present invention and no limitation is intended with respect to combinable features.

The present invention will be further clarified by the following examples, which are intended to be only exemplary of the present invention. Unless indicated otherwise, all amounts, percentages, ratios and the like used herein are by weight.

EXAMPLES

The following Examples provide results for brightness (% ISO), brightness increases, and CIE L*a*b* scale, and/or Kappa index values determined for bleached pulps that are pre-treated, before bleaching, with different compositions containing different additives. The "Control" was not pre-treated.

Example 1

Pulp was obtained from AlPac (Alberta, Canada). The type of fiber was northern bleached hardwood kraft. The treatment process applied to the pulp included three stages, including a pretreatment stage (X) in which the pulp was treated with a composition containing xylanase and a poloxamer, a chlorine dioxide bleaching stage including oxygen (Do), and an alkaline extraction stage including hydrogen peroxide (Ep). Xylanase ("XylA") was commercially obtained as an aqueous suspension (approx. 5 wt. % active enzyme solids) from Iogen Corporation. Xylanase ("XylB") was commercially obtained as an aqueous suspension (approx. 5 wt. % active enzyme solids) from Novozymes. The certified activity of the xylanase ("XylB") from the supplier was 1,000 AXU/g or 1,000 AXU/mL. The poloxamer was PLURONIC® F108 block copolymer surfactant ("Surf"), obtained from BASF Corporation. The xylanase and poloxamer were dispersed in an aqueous medium in concentrations shown in the table in FIG. 3 in units of "g/mT" or grams/metric ton ("Table I"). A metric ton equals 1,000 kilograms. A comparison composition ("LBL CONC") used was a cellulytic and hemi-cellulytic enzyme complex, obtained as FIBREZYME® LBL, from Dyadic International Inc., Jupiter Fla., U.S.A. The conditions of the stages of the bleaching process are as follows:

X Stage: 60 minutes, 50° C., pH 7.3-7.4, 10% by weight concentration of xylanase+poloxamer composition.

Do Stage: 45 minutes, 65° C., pH 2.0-2.1, 8% concentration, $ClO_2$ at 10 kg/metric ton fiber.

Ep Stage: 60 minutes, 65° C., pH 11.7-11.8, 10% concentration, $H_2O_2$ at 6 kg/metric ton fiber and NaOH at 1.2% by weight.

A pulp which was not pretreated (i.e., no X stage before the Do and Ep stages) was included as a Control. The brightness (ISO) of the pulps was determined after the extraction stage on handsheets prepared from the pulps. The handsheets were prepared according to TAPPI T 218 ("Forming Handsheets for Reflectance Tests of Pulp") or a substantially equivalent method. The whiteness and color of the pulps was evaluated be measurement of CIE L*a*b* scale values for the handsheets using a colorimeter.

Figure 4:
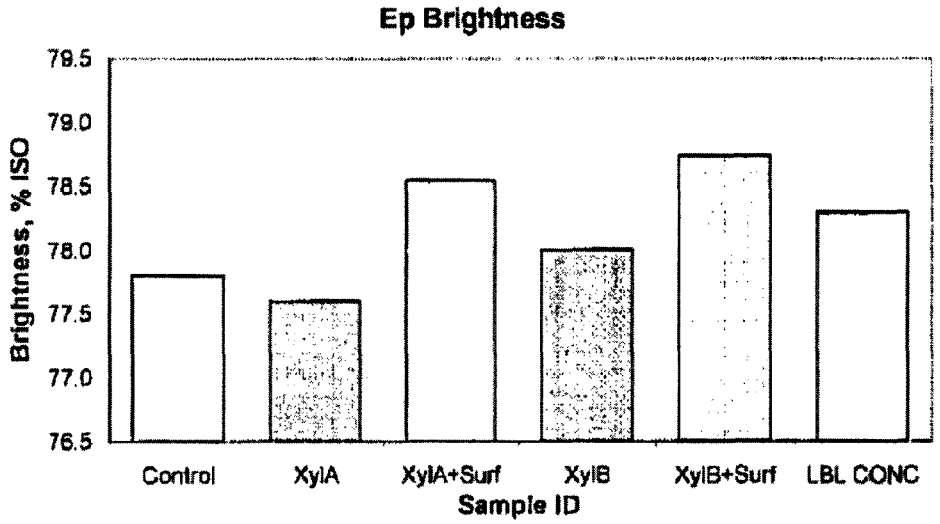
FIG. 4 is a bar graph showing the Brightness (% ISO) after a bleaching stage (Do) and an alkaline extraction stage (Ep) of a pulp fiber processing of the pulp fiber samples shown in FIG. 3.
Figure 5:
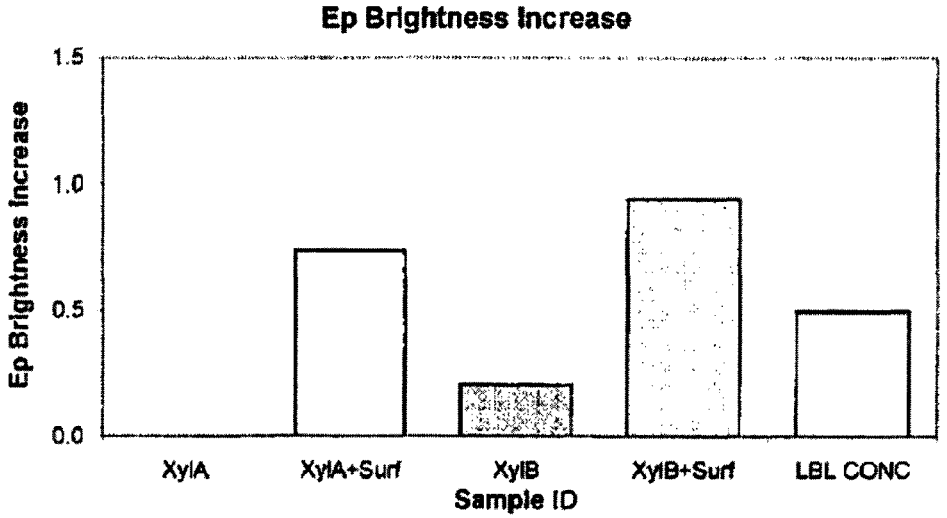
FIG. 5 is a bar graph showing the Ep Brightness increase for the pulp fiber samples treated by the different compositions as shown in FIGS. 3-4 with the values of brightness increase determined by comparison to the brightness value of the Control sample that was untreated with xylanase or the surfactant.

The table in FIG. 3 shows the brightness (% ISO), brightness increase, and CIE L*a*b* scale values determined for the pulps after both the chlorine dioxide bleaching stage Do and alkaline extraction stage Ep. The data in the table of FIG. 3 and the bar graphs in FIG. 4 show that the Brightness (% ISO) after the pretreatment stage (if used), the bleaching stage, and the alkaline extraction stage of pulp fiber processing were highest for the pulps pretreated with a composition comprising xylanase and poloxamer according to the present invention as compared to the Control (no X stage), or pulps treated with only the enzyme (xylanase) before the bleaching and extraction stages, or the comparison composition (LBL CONC). The data in the table of FIG. 3 and the bar graph in FIG. 5 show that the Brightness increase after the pretreatment stage (if used), the bleaching stage, and the alkaline extraction stage of pulp fiber processing were highest for the pulps pretreated with a composition comprising xylanase and poloxamer according to the present invention as compared to the Control (no X stage), or pulps treated with only the enzyme (xylanase) before the bleaching and extraction stages, or the comparison composition (LBL CONC). The brightness increase values in the table in FIG. 3 are normalized relative to the value of the Control sample.

With respect to the L*a*b* scale values shown in the table of FIG. 3, the L* values were highest for the pulps pretreated with a composition comprising xylanase and poloxamer according to the present invention as compared to the Control (no X stage), or pulps treated with only with the enzyme (xylanase) before the bleaching and extraction stages, or the comparison composition (LBL CONC).

The three coordinates of CIELAB represent the lightness of the color (L*=0 yields black and L*=100 indicates diffuse white; specular white may be higher), its position between red/magenta and green (a*, negative values indicate green while positive values indicate magenta) and its position between yellow and blue (b*, negative values indicate blue and positive values indicate yellow). With respect to the data in the table shown in FIG. 3, the higher L* values observed for the pulps pretreated with a composition comprising xylanase and poloxamer according to the present invention means that those pulps were whiter than the Control pulp and pulps treated with only the enzyme (xylanase) before the bleaching and extraction stages, or the comparison composition (LBL CONC).

Example 2

A range of experimental formulations containing the same organic contaminant removal adjuvant as Example 1 based on different dosages of a raw material xylanase (PULPZYME® HC, from Novozymes A/S, Denmark) were prepared for treatment of pulp. The experiments were used to compare the potential effectiveness of the xylanase to reduce Kappa number and subsequently enhance brightness.

The composition of the experimental formulation used for these experiments is indicated in Table 1:

TABLE 1

| Component (wt %) | Formulation 1 |
|---|---|
| Pulpzyme ® HC | 75 |
| Stabilizer | 10 |
| Pluronic ® F108 | 5 |
| Water | 10 |

The "Stabilizer" in Formulation 1 in Table 1 is an aqueous solution containing propylene glycol and polyvinylpyrrolidone.

A pulp which was not pretreated (i.e., no X stage before the Do and Ep stages) was included as a Control. In the testing, Kappa number (amount of xylan materials adhering to the cellulosic fiber) was determined on samples of pulp fiber after the treatment with the enzyme composition of Formulation 1 and for the Control composition. Pulp was used in these experiments that was similar to that used in Example 1. The conditions of all the stages of the process were as follows:

X Stage: Known weights of fiber samples were treated with known concentrations of enzymes samples with the composition of Formulation 1 for a pre-determined time and temperature, similar to those used in Example 1. Depending on the properties of the xylanase, the pH is typically slightly alkaline (pH=8).

Do Stage: The acidity of the treatments then was lowered to pH=2, and a known amount of an oxidant solution (typically $ClO_2$) was added, similar to the conditions used in Example 1.

Ep Stage: The acid and enzyme in each sample were neutralized with base and peroxide, and the fiber is rinsed, similar to the conditions used in Example 1.

After determining kappa numbers after the enzyme treatment (post-X stage) with Formulation 1, and after the Do and Ep stages, treated and bleached fiber samples were used to prepare paper samples ("handsheets") for measurements of brightness. Brightness was determined for both the wire and felt sides of the handsheets. During the paper manufacturing process, the side of the paper that does not touch the wire on the paper machine is the felt side, which is opposite to the wire side. For the Control, fiber which was untreated with Formulation 1 was bleached and used to prepare paper samples ("handsheets") for measurements of brightness. L*a*b* data were also measured for the handsheets. The results are shown in Table 2.

TABLE 2

| | | | Control | 250 | 500 | 750 | 1000 |
|---|---|---|---|---|---|---|---|
| Kappa (K) measurement after enzyme treatment | | | 23.37 | 22.98 | 22.79 | 22.73 | 22.55 |
| pH after Do stage | | | 2.07 | 2.09 | 2.14 | 2.08 | 2.13 |
| pH after Ep stage | | | 10.13 | 9.93 | 9.90 | 9.76 | 9.70 |
| Brightness (% ISO) | Wire side | | 43.7 | 44.3 | 45.3 | 45.0 | 44.7 |
| | Felt side | | 43.8 | 44.4 | 45.4 | 45.0 | 44.7 |
| Laboratory Color analysis | Wire side | L* | 83.92 | 84.17 | 84.72 | 84.46 | 84.26 |
| | | a* | 0.94 | 0.90 | 0.76 | 0.87 | 0.91 |
| | | b* | 21.15 | 20.86 | 20.70 | 20.61 | 20.62 |
| | Felt side | L* | 84.01 | 84.26 | 84.75 | 84.51 | 84.28 |
| | | a* | 0.93 | 0.90 | 0.78 | 0.87 | 0.93 |
| | | b* | 21.15 | 20.87 | 20.69 | 20.61 | 20.63 |

Figure 6:
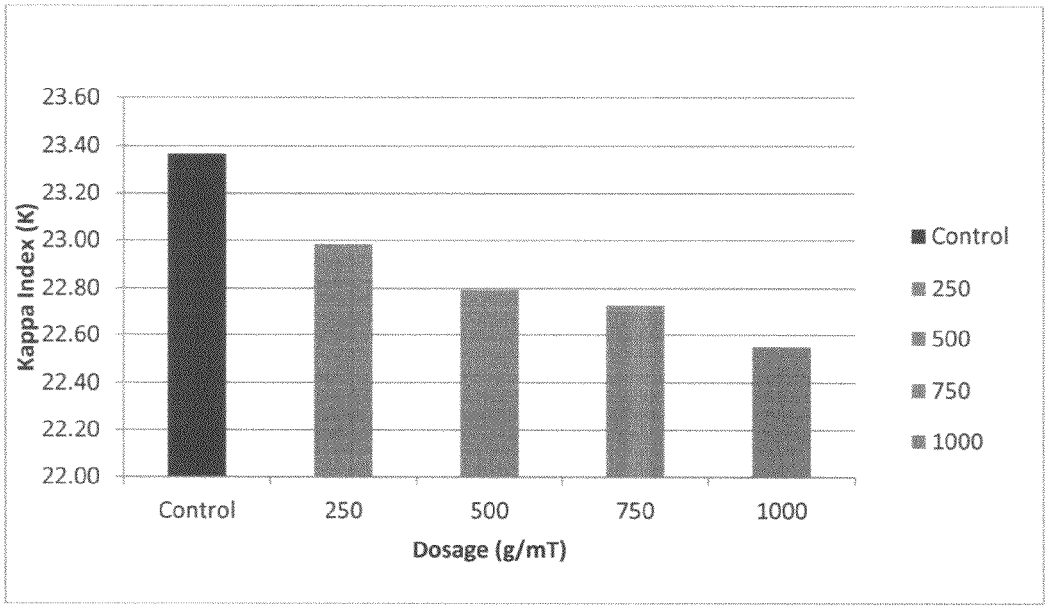
FIG. 6 is a bar graph showing Kappa Index (K) of a pulp fiber after enzyme and surfactant treatment before bleaching and alkaline extraction stages performed on pulp fiber samples according to an example of the present application, or without the pretreatment (Control).
Figure 7:
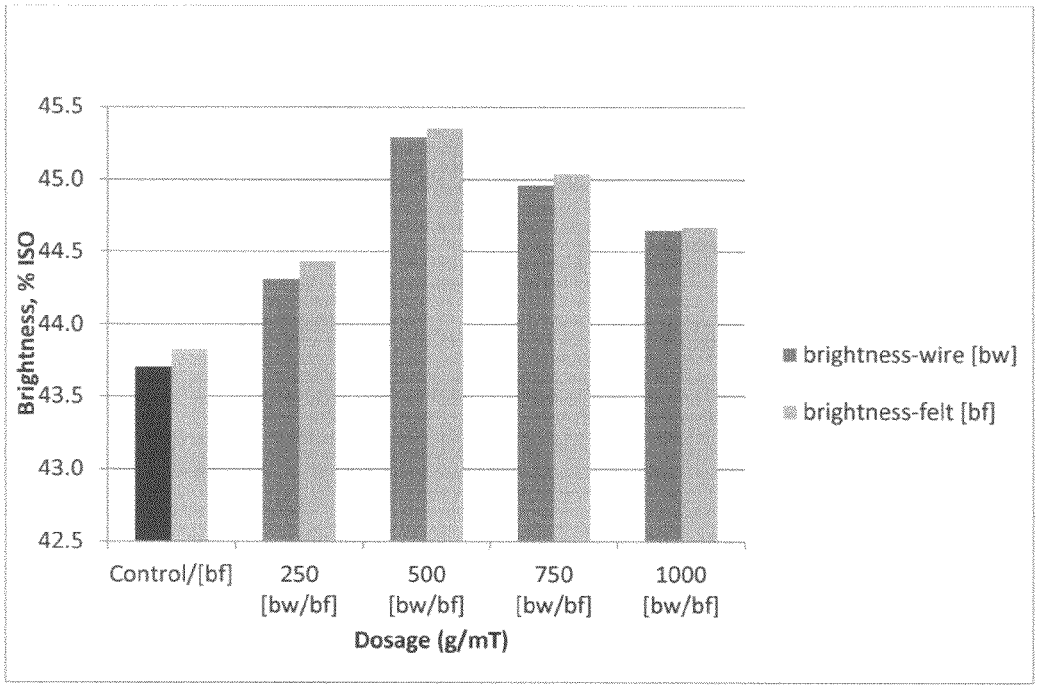
FIG. 7 is a bar graph showing the Brightness (% ISO) on the wire and felt side of the pulp fiber samples of the example shown in FIG. 6 after the pretreatment and bleaching and alkaline extraction stages according to an example of the present application, or for fiber samples with no pretreatment (Control).

The data in Table 2 demonstrates that there is a progressive reduction in kappa number of the fiber with increasing dosage (g/mT) of xylanase with the PLURONIC®F108 in the formulation used in the experiment. These results are shown in the bar graphs of FIG. 6, which show the higher Kappa number for the non-treated control fiber (Control) as compared to the treated fiber samples. A further result observed from the enzymatic reduction of the Kappa number of the pulp fiber is the concurrent improvement in the brightness of the fiber in the handsheet products made with the treated fiber, as measured by a laboratory instrument. This is shown in FIG. 7. An unexpectedly enhanced enzymatic tool (xylanase+ PLURONIC® F 108) to assist removal of xylans is shown by the measured reduction in kappa number and improvement in brightness (% ISO) under the given set of conditions in which Formulation 1 was tested. The maximum effective dosage of formulation for brightness increase for these experiments was identified as 500 g/mT.

Example 3

A lipase was tested for its enzymatic activity in a laboratory setting in the presence of various different surfactants. The lipase was added to the test system first. A surfactant was then added to the system, which included a substrate composition containing lipids. The enzymatic activity of the enzyme in the presence of a surfactant was compared to the activity of the same enzyme but not in the presence of the surfactant. The results are shown in Table 3. PLURONIC F108, a nonionic polymeric surfactant, was able to enhance the lipase activity by 54.4%. Two cationic surfactants, namely BFL-5031 and BFL-5376, were used instead of the PLURONIC F108 and actually inhibited the lipase activity by 45.9% and 57.7%, respectively. Another nonionic surfactant, TOMADOL 1-7, enhanced lipase activity by 13.9%. PLURONIC F108 was much better than TOMADOL 1-7 for improving lipase activity. An anionic surfactant, BSP-275, showed a negative effect by reducing lipase activity by 12.8%.

TABLE 3

Effects of Surfactants on Lipase Activity

| Surfactant | % Activity Change |
|---|---|
| PLURONIC F108 (nonionic) | +54.4 |
| BFL-5031 (cationic) | −45.9 |
| BFL-5376 (cationic) | −57.7 |
| BSP-275 (anionic) | −12.8 |
| TOMADOL 1-7 (nonionic) | +13.9 |

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A composition comprising a hemicellulolytic enzyme and an organic contaminant removal adjuvant capable of removing organic contaminants comprising one or more xylans, one or more pitch components, or both, from fibers in a greater amount than wherein the fibers are contacted with the composition without said organic contaminant removal adjuvant and said organic contaminant removal adjuvant is a polyalkyleneoxide block copolymer.

2. The composition of claim 1, wherein the organic contaminant removal adjuvant is a nonionic surfactant.

3. The composition of claim 1, wherein the organic contaminant removal adjuvant is a poloxamer.

4. The composition of claim 3, wherein the poloxamer comprises PLURONIC® F38, PLURONIC® F68, PLURONIC® F88, PLURONIC® F98, PLURONIC® F108, PLURONIC® F87, PLURONIC® P105, PLURONIC® F127, or any combination thereof.

5. The composition of claim 1, wherein the organic contaminant removal adjuvant is a poloxamer having an HLB value of 16 or more.

6. The composition of claim 1, wherein the hemicellulolytic enzyme is xylanase, or mannanase, or any combinations thereof.

7. The composition of claim 1, wherein the composition further comprises a lipolytic enzyme.

8. The composition of claim 1, wherein composition comprises from about 10% to about 90% by weight of said hemicellulolytic enzyme, and from about 1.0% to about 10% of said organic contaminant removal adjuvant, based on total solids weight of said composition.

9. The composition of claim 1, wherein the polyalkyleneoxide block copolymer comprises a first block of a first lower alkylene oxide monomer.

10. The composition of claim 9, wherein the first lower alkylene oxide monomer comprises a C2, a C3, or a C4 alkylene oxide chain.

11. The composition of claim 9, wherein the polyakyleneoxide block copolymer comprises a second block of a second lower alkylene oxide monomer, wherein the second lower alkylene oxide monomer is different than the first lower alkylene oxide monomer.

12. The composition of claim 11, wherein the first block and second block comprise a block of polyethylene oxide (PEO) monomers and a block of polypropyleneoxide (PPO) monomers, respectively, or a block of polypropyleneoxide (PPO) monomers and a block of polyethylene oxide (PEO) monomers, respectively.

13. The composition of claim 1, wherein the polyalkyleneoxide block copolymer is amphiphilic.

14. The composition of claim 1, wherein the polyalkyleneoxide block copolymer comprises a hydrophilic polyalkylene block and a hydrophobic polyalkylene block.

15. The composition of claim 1, wherein the polyalkyleneoxide block copolymer is a difunctional block copolymer surfactant.

16. The composition of claim 1, wherein the polyalkyleneoxide block copolymer terminates in primary hydroxyl groups.

* * * * *